United States Patent [19]

Shuman

[11] Patent Number: 5,034,313

[45] Date of Patent: Jul. 23, 1991

[54] METASTABLE METAL COLLOIDS AND PREPARATION

[75] Inventor: David C. Shuman, Victor, N.Y.

[73] Assignee: Eastman Kodak Company, Rochester, N.Y.

[21] Appl. No.: 344,950

[22] Filed: Apr. 28, 1989

[51] Int. Cl.[5] ..... G03C 1/725

[52] U.S. Cl. ..... 430/616; 430/292; 430/346; 430/495; 430/964

[58] Field of Search ..... 430/616, 964, 346, 348, 430/198, 290, 292, 3, 495; 346/76 L

[56] References Cited

U.S. PATENT DOCUMENTS 4,425,570 1/1984 Bell et al. .

4,762,770 8/1988 Bouldin et al. ..... 430/273

OTHER PUBLICATIONS

Wang and Kerker, 24 *Physical Review B,* pp. 1777-1790 (1981).

Defensive Publication T 900,010.

*Primary Examiner*—Charles L. Bowers, Jr.

*Assistant Examiner*—Mark R. Buscher

*Attorney, Agent, or Firm*—Oblon, Spivak, McClelland, Maier & Neustadt

[57] ABSTRACT

A particulate metastable Group Ib metal colloid is prepared is formed by plating a Group Ib metal onto small nuclei in a suspension to form non-spherical particles of varying color. The preparation is stable below about 100° C., but when coated onto a support, can be used to form a visible image by application of thermal energy.

5 Claims, No Drawings

METASTABLE METAL COLLOIDS AND PREPARATION

BACKGROUND OF THE INVENTION

1. Field of the Invention

This invention is directed to a preparation involving Group Ib metals which may be selectively, thermally recrystallized to provide a differentiated color form useful for imaging. In a preferred embodiment, a particulate metastable silver colloid is prepared, which may be subsequently distributed on a substrate, and selectively subjected to thermal energy, to provide a yellow image on a differentiated background.

2. Background of the Prior Art

Defensive Publication T 900,010 describes blue colloidal silver of relatively large particle diameter, which is unstable, and is formed in-situ on a support and subsequently converted to a yellow image on a blue field by the application of halide ions. The halide imaging agent can be transferred from exposed and developed silver halide sources, such as previously developed film, or from an alternative source, such as human skin.

The invention that is the subject of this Defensive Publication by Shuman provides a method for creating distinct yellow images, against a blue background, with minimal difficulty. However, the composition is merely a precursor, requires final preparation on the support itself, and has minimal commercial value. Thus, the Defensive Publication does not describe a practical method for preparing a stable composition which may be used to form a layer on a support and converted, at a later time, nor does it provide a stable preparation which may be subsequently applied to a substrate and imaged. Moreover, the halide chemical imaging process of the Defensive Publication is in many ways constrained, and does not permit the fine control necessary for thermal imaging.

Accordingly, it would be desirable to provide a metastable silver composition which may be selectively converted to provide a yellow image, without the drawbacks and obstacles noted that characterize the prior art.

SUMMARY OF THE INVENTION

The obstacles encountered in the prior art in the preparation of a metastable silver having adequate shelf life and capable of being selectively imaged are met by providing a particulate metastable Group Ib metal colloid which, when coated on a support, can be converted from a non-spherical particulate form of a first color to a stable spherical particulate form of a second color by the application of thermal energy, said colloid comprising nuclei having an electrolessly plated layer thereon of said Group Ib metal dispersed in a coatable matrix, said colloid being stable against conversion to said spherical particulate form at ambient temperature conditions. These nuclei are created by adding a solution of stable metal-ion containing material, e.g., silver nitrate, to a silver peptizing agent such as an aqueous gelatin solution containing a reducing agent such as potassium borohydride. If the peptizing agent is gelatin, the suspended silver nuclei are stirred and then cooled to set the gelatin. The resulting solid dispersion is pressed through a screen, to produce metal nuclei within gelatin particles of defined diameter. Finally, the preparation is further diluted to provide a slurry of nuclei in a solid gelatin matrix distinct from the aqueous phase. Although this medium is preferably gelatin, other hydrophilic polymers or alkali metal fatty acid salts as disclosed in U.S. Pat. No. 3,814,696 may be used.

The nuclei in the dispersion are amplified by treatment with a solution of a hydroquinone monosulfonate or similar reducing compound, which solution is in turn added to a silver sulfite solution. The sulfite complexing solution also contains an agent, e.g., a calcium salt, for promoting the growth of silver platelet forms.

The formation of the metastable form of silver will go forward at an appropriate pH of about 9.0–10.0, undergoing a progressive color change which starts at yellow, and proceeds to orange - magenta - purple - blue. The reaction can be quenched at any time by dilution with distilled water, to produce metastable silver-coated particles of any desired color prepared in the reaction process. The metastable silver particles in distinct phase are collected by filtration through a nylon mesh bag or similar means, and are stable as prepared. This metastable form has extended shelf life under refrigeration. When subsequently applied to a support and dried, the preparation can be selectively "imaged", that is, converted to the stable yellow form, by the application of thermal energy. This creates a yellow image against a blue, or other color background. Unlike the prior art that refers to production of a homogeneous matrix, in the present invention, discrete particles are preferentially produced, so that the product is more easily concentrated and purified. Furthermore, because excess salts are removed which tend to retard silver conversion, the invention offers better control of thermal sensitivity.

Although silver is preferred, metastable colloids can be prepared from other Group Ib metals such as gold and copper. Colloidal metallic gold is prepared using a gold salt to displace any metal more electronegative (less noble) to redox displacement. For example, the metastable silver of this invention is a convenient source of the displacement reaction because it will generate gold particles of nearly the same size as the starting silver nuclei. Such displacement reactions usually produce a colloid with a sintered non-spherical shape with optical properties different than the corresponding spherical colloid. These non-spherical particles are convertible to the spherical form accompanied by a color change by input of thermal energy.

Thus, the colloidal preparation of this invention is generally obtained by forming nuclei of a size less than about 20 nanometers in diameter dispersed in a matrix, mixing a solution of said nuclei-containing dispersion with a Group Ib metal ion-containing solution, allowing the nuclei in said solution to be electrolessly plated with said Group Ib metal, said plated nuclei being capable of undergoing a color change, and quenching said plating process to obtain particles of the desired color.

DETAILED DESCRIPTION OF THE INVENTION

The particulate metastable colloidal Group Ib metal such as silver of this invention is critically prepared on nuclei which have a particle size of less than about 20 nanometers (nm). The nuclei are subsequently electrolessly plated or coated, during the amplification process, with metallic silver. It is therefore clear that silver nuclei are particularly convenient as coating or plating with silver is facilitated, and in addition, silver nuclei of the required dimension are easily prepared. However, other materials that can be easily plated with silver may be substituted as nuclei. Examples include the noble metals, such as gold and palladium, a heavy metal sulfide such as silver sulfide, and nickel sulfide. Generally, the noble metals have the highest stability in gelatin dispersions, and accordingly, are particularly preferred.

Nuclei preparation is begun by precipitating the metal in an aqueous solution of a peptizing agent, such as gelatin, other hydrophilic synthetic or natural polymers, or peptizers such as alkali metal fatty acid salts, e.g., sodium caprate, potassium palmitate, and sodium laurate. One convenient method of preparing ultra-fine nuclei of convenient size is by reduction with potassium borohydride. Other strong reducing agents such as citrate tannic acid, dextrin, and dimethylamineborane may also be used. A salt solution of the metal ion used to form the nuclei is added with vigorous stirring to the gelatin containing the reducing agent. A preferred metal salt is silver nitrate although any soluble silver form is acceptable. The reduction of the silver ions by the borohydride or other reducing agent gives exceedingly fine metal nuclei particles, which can be used as a substrate, during the amplification process, to form platelets of tabular shape of extremely fine size, leading to improved imaging. The nuclei dispersed in gelatin are then chill-set by cooling. The resulting dispersion is extruded through a screen to form nuclei dispersed in discrete gelatin particles. If a 50 mesh stainless steel screen is used, the 5–7 nm diameter nuclei are dispersed in gelatin having an average diameter of about 250–300 micrometers. Other division means, such as a blender, ball mill, etc. can be employed. To prevent the gelatin particles from agglutinating into large clumps, which would defeat uniform amplification in later use, the dispersion may be further diluted.

The nuclei are plated with silver, and converted to the metastable form, by preparing a solution of, e.g., ionic silver, with a complexing agent, such as sodium sulfite in the presence of an alkaline earth ion promoter such as calcium acetate. If necessary, a buffering agent, to establish a pH of about 9.0 to about 10.0 may be added to the solution. The previously prepared nuclei are added to this silver-plating solution, together with a reducing agent. An exemplary reducing agent which operates at the established pH is potassium hydroquinone monosulfonate. Other reducing agents can be employed.

The two solutions are mixed, and if necessary, the pH is again adjusted to maintain a value of 9.0–10.0. The amplification reaction proceeds to convert the silver to the metastable, non-spherical form. Positive presence of the reaction is confirmed by the color change undergone by the particles, which progressively proceeds from the initial yellow, to orange, magenta, purple, and finally blue. Extended amplification may be used to produce a green color. Thus, any of the intermediate colors, as well as the blue form, can be prepared. To stop the reaction at any point in the pathway, the reaction is quenched by dilution with water or by draining off the reactants. The remaining dispersion is collected, melted, and filtered.

The collected particles are non-spherical in form with an average edge length of approximately 20 nm up to about 40 nm, and a thickness of about 6 nm up to about 12 nm. All forms having a non-yellow color are non-spherical.

The resulting metastable silver colloid can be coated when desired on one or both sides of a substrate, which may be transparent or reflective, rigid or flexible, and solid or open textured, and "imaged" by exposure to a source of thermal energy. One such source is a thermal-head typewriter. Thus, the thermal head applied to the layer of metastable silver will develop a yellow image where ever the head is applied, against a, e.g., blue background corresponding to unexposed areas. The resulting image is stable at ambient temperatures. Furthermore, the metastable silver is thermally stable providing it is kept below the glass transition temperature of the medium in which the silver is dispersed.

If desired, further stabilization of the image may be done by a variety of physical means, including lamination and use of protective overcoats. The resulting image has utility for applications including projection slides, reflection prints, identification-security cards, and bar-coded areas.

In following the above process, certain parameters should be observed to optimize results. The initial preparation of the nuclei is important to improve uniformity of the final dispersion and image, as well as preventing aggregation that will hinder further preparation. Moreover, nuclei of small and uniform dimension provide better control over the color of the metastable phase selected and stability of the colloidal silver over time. Thus, a maximum average particle size of about 20 nanometers is preferred to provide ultra-fine particles. Nuclei prepared by borohydride reduction are preferred, although other ultra-fine metals, such as gold have been used with success.

When gelatin is used in the preparation of the nuclei, its concentration can be relatively low, but yet allows the dispersion to be chill-set firmly. This permits the production of small particles of gelatin as a separate phase distinct from the aqueous phase, which is preferred. The amount of gelatin can be reduced to the lowest value where the gelatin particles still retain integrity. Weight ratios of nuclei material, as e.g., silver to dry gelatin (or other peptizing agents), can be from about 1:30 to as high as about 1:5.

In the final imaging material, the energy requirement for conversion depends on the ratio of plated silver to gelatin. If the ratio is too low (high gelatin), more energy is required because the heat is dissipated in the gelatin.

As noted, the nuclei may be silver, but other metals, particularly noble metals or heavy metal sulfides, can be used as well. Concentration and size are of equal importance in determining color and stability of the amplified particles. In the amplification mixture, the weight ratio of the amplified metallic silver to peptizing agent may be as high as about 1:1. The degree of amplification of the silver particles governs the resulting color. Lower degrees of amplification will result in particles having "transition" colors, e.g., orange, magenta or purple; the highest amplification gives larger particles, having a blue or green color. The amplification value of nuclei to silver controls the degree of color change. An amplification factor of 2 gives a discernable color change. Values as high as 50 may be used.

The amplification chemistry performs optimally in the presence of certain compounds. A negatively charged complexing agent, such as sulfite is preferred. Other known agents, such as thiocyanates and thiosulfates tend to recrystallize or otherwise convert the formed platelets into spheres, the stable phase, in contrast to sulfite which preferentially stabilizes platelet, or non-spherical growth. Care should be take to maintain the concentration of sulfite below a maximum level. Excess sulfite concentration or long-term exposure, further stabilizes the platelets, making them difficult to recrystallize, and produce an acceptable yellow image. Thus, a minimum weight ratio of sodium sulfite to silver nitrate of 2:1 should be observed to promote platelet growth, but should not exceed a maximum weight ratio of 20:1.

Calcium or other alkaline earth ions are also useful in promotion of platelet formation, and in particular, for uniformity of amplification. Calcium is preferably provided by gelatin itself, but can be provided from any convenient salt which is easily dissolved and should be maintained at a low concentration.

The pH of the amplification chemistry should be maintained between 9.0–10.0. At lower pHs, the amplification rate is lowered, resulting in a termination of the color transition at the magenta stage. A preferred pH range is 9.25–9.5. Borax conveniently buffers the amplification solution at a pH of 9.0–9.5. Other buffers may be used to obtain the desired pH.

In the preparation of the solutions to be employed in the amplification reaction, and the stable preparation of tabular silver, precautions must be observed to ensure the absence of any recrystallizing agents, that would convert the product back to the yellow form. In particular, the significant presence of halides should be excluded, but other possible recrystallizing agents, such as certain surfactants should also be avoided.

In general, the concentration values in the amplification chemistry should be balanced to ensure that diffusion of the chemicals through the dispersing phase proceeds apace with silver deposition. Thus, a complexing agent is used to limit available silver, while alkaline earth ions tend to promote deposition.

The invention can be further understood by reference to the Examples set forth below.

The first two examples illustrate preparation of the metastable silver colloid, which has extended shelf life in the absence of halide ions at temperatures below about 100° C.

EXAMPLE 1

This example describes the preparation of metastable colloidal silver by amplification of a slurry of gelatin particles containing pre-formed nuclei.

The nuclei are prepared as follows:

Deionized gelation (3.5 g) was dissolved in distilled water (350 ml). Potassium borohydride (0.18 g) was added with stirring and the solution was heated to 40° C. A solution of silver nitrate (0.35 g) in distilled water (100 ml) was added rapidly in one portion with vigorous stirring. This mixture was then added with stirring to a deionized gelatin in water solution (7.7 g/500 ml). Additional water was added to adjust the weight (to 1.0 kg), and the mixture was cooled below 0° C. for chill-setting. The resulting dispersion of nuclei 5–7 nm in diameter was pressed through a 50 mesh stainless steel screen to produce gelatin particles about 280 micrometers in diameter. To prevent the gelatin from agglutinizing into large clumps, the dispersion was further diluted with twice its weight in water.

The amplification process is described below:

A solution of silver nitrate (0.60 g in 50 mL distilled water) was added with stirring to a solution (500 mL) of anhydrous sodium sulfite (1.2 g), sodium tetraborate decahydrate (5.0 g), and calcium acetate monohydrate (0.025 g) and then cooled to 15° C.

To a portion of the previously prepared nuclei dispersion (150 g) chilled to 10° C., a solution of potassium hydroquinone monosulfonate (1.14 g/200 mL) was added with stirring and cooling. This solution was added with moderate stirring to the cooled "silver nitrate sulfite-borate" solution at 15° C., diluted to 1000 mL with distilled water, and adjusted to pH 9.37 with dilute nitric acid or sodium hydroxide.

During this amplification the particles undergo a color change from yellow to orange to magenta to purple to blue. The reaction may be quenched at a given time to produce a metastable silver of a given hue; blue particles were specifically produced by pouring the slurry into 1.5 l of distilled water at 10° C. after 6 minutes. The silver sol particles were collected by passage of the slurry through a fine-mesh nylon dispersion bag, then redispersed in 3.0 l distilled water at 10° C. After being stirred occasionally for 10 minutes, the particles ware again collected in a nylon mesh bag, immediately melted, and filtered through Whatman No. 2 paper.

The blue metastable silver produced by the above preparation was essentially triangular tabular in form with edge length of approximately 20 nanometers and about 6 nanometers in thickness with an average mass approximately that of Carey Lea silver.

The suitability of these silver particles was tested using the following "chloride test". One drop of filtered material was diluted to 10 ml with 2% potassium chloride solution. An immediate conversion from blue to yellow was observed. This demonstrated that the silver sol had the desired properties and was converted from the metastable platelet form to the stable spherical yellow form.

EXAMPLE 2

This example is similar to Example 1 but illustrates how metastable colloidal silver may be prepared in a variety of hues by modification of the amplification process.

The preparations of the colloids was as described in Example 1, however, the solution of silver nitrate specified previously as 0.60 g in 50 mL distilled water was changed for the amplification process. The following results were obtained:

| AMPLIFICATION | | COLLOID PRODUCED | |
|---|---|---|---|
| Silver Nitrate | factor* | Color | max (nm) |
| 0. g/50 mL (control) | 0 | Yellow | 404 |
| 0.08 g/50 mL | 5× | Rusty Orange-Red | 470 |
| 0.15 g/50 mL | 10× | Burgundy | 504 |
| 0.25 g/50 mL | 15× | Purple | 527 |
| 0.40 g/50 mL | 25× | Blue-Purple | 556 |
| 0.60 g/50 mL (Ex. 1) | 35× | Blue | 628 |
| 0.80 | 45× | Blue | 650 |
| 1.00 g/50 mL | 55× | Blue Green | 661 |

*Amplification factor is that ratio of the average particle mass of physically developed nuclei compared with the average particle mass of the starting nuclei.

EXAMPLE 3

This example describes the preparation of metastable colloidal gold by a silver displacement reaction.

To a dispersion of metastable colloidal silver (3.0 g) (consisting of 0.45 weight percent silver in 0.8 weight percent gelatin) (prepared as described in Example 1), a solution of potassium chloraurate (0.15 g) dissolved in water (9.5 g) was added dropwise with vigorous stirring. During the addition, the color changed from blue to purple to dark orange to neutral. Analysis indicated the silver particles were exchanged completely by gold (a metallic gold representing 0.21 percent of the dispersion weight). The colloid was coated on a transparent poly(ethylene terephthalate) support, dried, and found to have a nearly neutral absorption spectrum.

The suitability of these gold particles was tested using a "heat test". The coating was placed on top of a hot plate heated to approximately 135° C. for 30 seconds. An intermediate conversion from neutral to burgundy was observed. This demonstrated that the gold sol had the desired properties and was converted from the metastable form to the stable spherical burgundy form.

EXAMPLE 4

This example demonstrates image formation by application of thermal energy to the colloid, as coated on a support.

The metastable silver colloid coating was prepared using the colloid described in Example 1. On a 175 micrometer thick polyethylene terephthalic support a subbed layer of deionized bone gelatin (6.5 $g/m^2$) and bis(vinylsulfonyl)methane (6.34 $g/m^2$) was coated. On top of the subbed layer, the colloid of Example 1 (0.27 $g/m^2$) in deionized bone gelatin (1.1 $g/m^2$) was coated.

The silver colloid coating was placed coated side out, on the platen of a Sears 600 portable thermal typewriter, Catalog Number 3H5394C, and the machine was set in the mode used to print images on thermal paper without a ribbon. Characters were typed and appeared as yellow areas where heated by the thermal head.

Other methods of delivering heat to the coating may be used. The formation of discrete yellow images appear to require a minimum energy threshold of about 1.6 nanojoule per 1 micrometer spot.

What is claimed is:

1. A particulate metastable metal colloid which, when coated on a support, can be converted from a non-spherical particulate form of a first color to a stable spherical particulate form of a second color by the application of thermal energy, said colloid comprising tabular particles consisting of nuclei less than 20 nanometers in diameter and consisting of metal compounds selected from the group consisting of noble metals, silver sulfide and nickel sulfide, said nuclei having an electrolessly plated layer of silver thereon, and being dispersed in a coatable matrix, said colloid being stable against conversion to said spherical particulate form at ambient temperature conditions.

2. The colloid of claim 1 wherein said noble metal is silver.

3. The colloid of claim 1, wherein said plated nuclei have an edge layer up to about 40 nanometers and a thickness of up to about 12 nanometers.

4. The colloid of claim 1, wherein said matrix comprises gelatin.

5. The colloid of claim 1, wherein the weight ratio of said nuclei to said matrix is from about 1:5 to 1:30, on a dry basis.

* * * * *